US009528525B2

(12) United States Patent
Yamaguchi

(10) Patent No.: US 9,528,525 B2
(45) Date of Patent: Dec. 27, 2016

(54) VACUUM PUMP

(75) Inventor: Toshiki Yamaguchi, Kawanishi (JP)

(73) Assignee: SHIMADZU CORPORATION, Kyoto-shi, Kyoto (JP)

( * ) Notice: Subject to any disclaimer, the term of this patent is extended or adjusted under 35 U.S.C. 154(b) by 648 days.

(21) Appl. No.: 13/577,318

(22) PCT Filed: Jun. 11, 2010

(86) PCT No.: PCT/JP2010/059934
§ 371 (c)(1),
(2), (4) Date: Aug. 6, 2012

(87) PCT Pub. No.: WO2011/102006
PCT Pub. Date: Aug. 25, 2011

(65) Prior Publication Data

US 2012/0308380 A1 Dec. 6, 2012

(30) Foreign Application Priority Data

Feb. 16, 2010 (JP) ..... 2010-031233

(51) Int. Cl.
*F04D 19/04* (2006.01)
*F04D 29/054* (2006.01)
*F04D 29/26* (2006.01)

(52) U.S. Cl.
CPC ..... *F04D 19/042* (2013.01); *F04D 29/054* (2013.01); *F04D 29/266* (2013.01)

(58) Field of Classification Search
CPC .... F04D 19/044; F04D 29/266; F04D 29/054; F04D 19/042
See application file for complete search history.

(56) References Cited

U.S. PATENT DOCUMENTS 1,675,087 A * 6/1928 Biersach ..... 416/146 R
4,147,468 A * 4/1979 Murakami et al. ..... 415/216.1
(Continued)

FOREIGN PATENT DOCUMENTS

CN 101213372 A 7/2008
DE 102007048703 A1 4/2009
(Continued)

OTHER PUBLICATIONS

Chinese Office Action dated Aug. 26, 2014, issued in corresponding Chinese Patent Application No. 201080063956.6, w/English translation (17 pages).
(Continued)

*Primary Examiner* — Dwayne J White
*Assistant Examiner* — Adam W Brown
(74) *Attorney, Agent, or Firm* — Westerman, Hattori, Daniels & Adrian, LLP

(57) ABSTRACT

A vacuum pump includes a rotor shaft 33 that is rotatably supported by a bearing and driven by a motor 36 to rotate at a high speed, and a rotor 30 that is fastened to one end of the rotor shaft 33 in axial direction thereof and is provided with an evacuating function portion. An engagement portion, in which the rotor shaft 33 and the rotor 30 are fastened, includes an engagement hole 330 formed on one of the rotor shaft 33 and the rotor 30 and an engagement shaft 300 formed on the other of the rotor shaft 33 and the rotor 30. A filling member 40 is provided in a gap between the engagement hole 330 and the engagement shaft 300, having shear strength lower than respective shear strengths of the rotor 30 and the rotor shaft 33.

13 Claims, 14 Drawing Sheets

(56) References Cited

U.S. PATENT DOCUMENTS

| | | | | |
|---|---|---|---|---|
| 5,221,184 | A * | 6/1993 | Gesenhues et al. | 415/216.1 |
| 2001/0015013 | A1 | 8/2001 | Kato et al. | |
| 2002/0159899 | A1 | 10/2002 | Yamashita | |
| 2005/0239558 | A1* | 10/2005 | Brandt et al. | 464/89 |
| 2006/0021221 | A1* | 2/2006 | Decker | 29/889.61 |
| 2009/0214348 | A1* | 8/2009 | Buccheri et al. | 416/204 A |
| 2009/0245707 | A1 | 10/2009 | Schmidt et al. | |
| 2010/0290915 | A1 | 11/2010 | Englaender | |

FOREIGN PATENT DOCUMENTS

| | | | |
|---|---|---|---|
| JP | 10-094934 | A | 4/1998 |
| JP | 10-96576 | A | 4/1998 |
| JP | 2000-297782 | A | 10/2000 |
| JP | 2001-227465 | A | 8/2001 |
| JP | 2005-264772 | A | 9/2005 |
| JP | 2007-239464 | A | 9/2007 |
| JP | 2008-038844 | A | 2/2008 |
| JP | 3144272 | U | 8/2008 |
| KR | 2001-0081993 | A | 8/2001 |
| KR | 2002-0084411 | A | 11/2002 |

OTHER PUBLICATIONS

International Search Report of PCT/JP2010/059934, mailing date Sep. 7, 2010.

Japanese Office Action dated May 13, 2014, issued in corresponding Japanese Patent Application No. 2012-500447, w/English translation (8 pages).

Office Action dated Apr. 27, 2015, issued in corresponding Chinese application No. 201080063956.6, with English translation (19 pages).

* cited by examiner

VACUUM PUMP

TECHNICAL FIELD

The present invention relates to a vacuum pump provided with a rotor that can rotate at a high speed.

BACKGROUND ART

Heretofore, in a turbomolecular pump, a rotor conventionally has a construction of a rotating body that includes a rotor shaft supported by a bearing (magnetic bearing or mechanical bearing) and a rotor provided with vanes; the rotor and the rotor shaft are fastened with bolts to integrate them with each other. As the fastening structure is adopted a fitting structure in which either an engagement shaft provided on the rotor shaft side is inserted into an engagement hole provided on the rotor side, or an engagement shaft provided on the rotor side is inserted into an engagement hole provided on the rotor shaft side. Generally, "shrink fit" is used as the fitting structure in a turbomolecular pump, in which the rotor and the rotor shaft rotate at a high speed and which requires a severe balance (see Patent Reference 1, 40th paragraph).

CITATION LIST

Patent Literature

[Patent Reference 1] Japanese Patent Laid-open Publication No. 2007-239464

SUMMARY OF INVENTION

Technical Problem

"Shrink fit" causes less loosening in the fitting portion during operation of the pump. However, it requires heating on the side of the engagement hole and cooling on the side of the engagement shaft upon the fastening. Therefore, it takes a considerable time for assembly work.

A turbomolecular pump suffers plating peeling off or deterioration of the rotary vanes and the rotor main body, so that it is necessary to repair or exchange the rotor at a predetermined frequency. However, in case of "shrink fit", the fitting portion must be punched off with a press in order to disassemble the already fastened components. Thus it is laborious to withdraw the engaging shaft from the engaging hole, so that it takes much time for the repair/exchange work.

Solution to Problem

According to the 1st aspect of the present invention, a vacuum pump comprises: a rotor shaft that is rotatably supported by a bearing and driven by a motor to rotate at a high speed; a rotor that is fastened to one end of the rotor shaft in axial direction thereof and is provided with an evacuating function portion; an engagement portion being provided in a fastening portion of the rotor shaft and the rotor, including an engagement hole formed on one of the rotor shaft and the rotor and an engagement shaft formed on the other of the rotor shaft and the rotor to be inserted into the engagement hole; and a filling member provided in a gap between the engagement hole and the engagement shaft, having shear strength lower than respective shear strengths of the rotor and the rotor shaft.

According to the 2nd aspect of the present invention, in a vacuum pump according to the 1st aspect, it is preferred that the filling member comprises an adhesive that bonds an inner circumferential surface of the engagement hole and an outer circumferential surface of the engagement shaft.

According to the 3rd aspect of the present invention, in a vacuum pump according to the 2nd aspect, it is preferred that a groove for retaining an adhesive is formed on at least one of the engagement hole and the engagement shaft, the groove being ditched on the inner circumferential surface of the engagement hole or on the outer circumferential surface of the engagement shaft.

According to the 4th aspect of the present invention, in a vacuum pump according to the 3rd aspect, it is preferred that the rotor shaft is provided with the engagement shaft and the rotor is provided with the engagement hole, and the groove for retaining an adhesive is provided in the engagement shaft of the rotor shaft.

According to the 5th aspect of the present invention, in a vacuum pump according to the 3rd aspect, it is preferred that the rotor shaft is provided with the engagement hole, the rotor is provided with the engagement shaft, and the groove for retaining an adhesive is provided in the engagement hole for the rotor shaft.

According to the 6th aspect of the present invention, in a vacuum pump according to any one of the aspects 3 to 5, it is preferred that the groove for retaining an adhesive is provided annularly along the inner circumferential surface of the engagement hole or along the outer circumferential surface of the engagement shaft in a circumferential direction thereof.

According to the 7th aspect of the present invention, in a vacuum pump according to any one of the aspects 3 to 6, it is preferred that a plurality of the grooves for retaining an adhesive are provided annularly along the inner circumferential surface of the engagement hole or along the outer circumferential surface of the engagement shaft in a circumferential direction thereof.

According to the 8th aspect of the present invention, in a vacuum pump according to any one of the aspects 3 to 7, it is preferred that the groove for retaining an adhesive is provided on both the inner circumferential surface of the engagement hole and the outer circumferential surface of the engagement shaft.

According to the 9th aspect of the present invention, in a vacuum pump according to any one of the aspects 2 to 8, it is preferred that an escape for receiving the adhesive is provided on a foot portion of the engagement shaft.

According to the 10th aspect of the present invention, in a vacuum pump according to the 1st aspect, it is preferred that the filling member comprises a ring-shaped thin plate.

According to the 11th aspect of the present invention, in a vacuum pump according to any one of the aspects 1 to 10, it is preferred that the filling member has shear strength that is equal to or less than ⅕ of shear strength of the rotor.

Advantageous Effect of the Invention

According to the present invention, it becomes easy to fit a rotor shaft in a rotor, so that assembly of a vacuum pump can be done efficiently. In addition, in a vacuum pump in which a rotor provided with rotary vanes rotates at a high speed, loosening of engagement between the engagement shaft and the engagement hole due to high speed rotation can be prevented while improving workability of disassembling the rotor shaft from the rotor.

DESCRIPTION OF EMBODIMENTS

Embodiment 1

Figure 1:
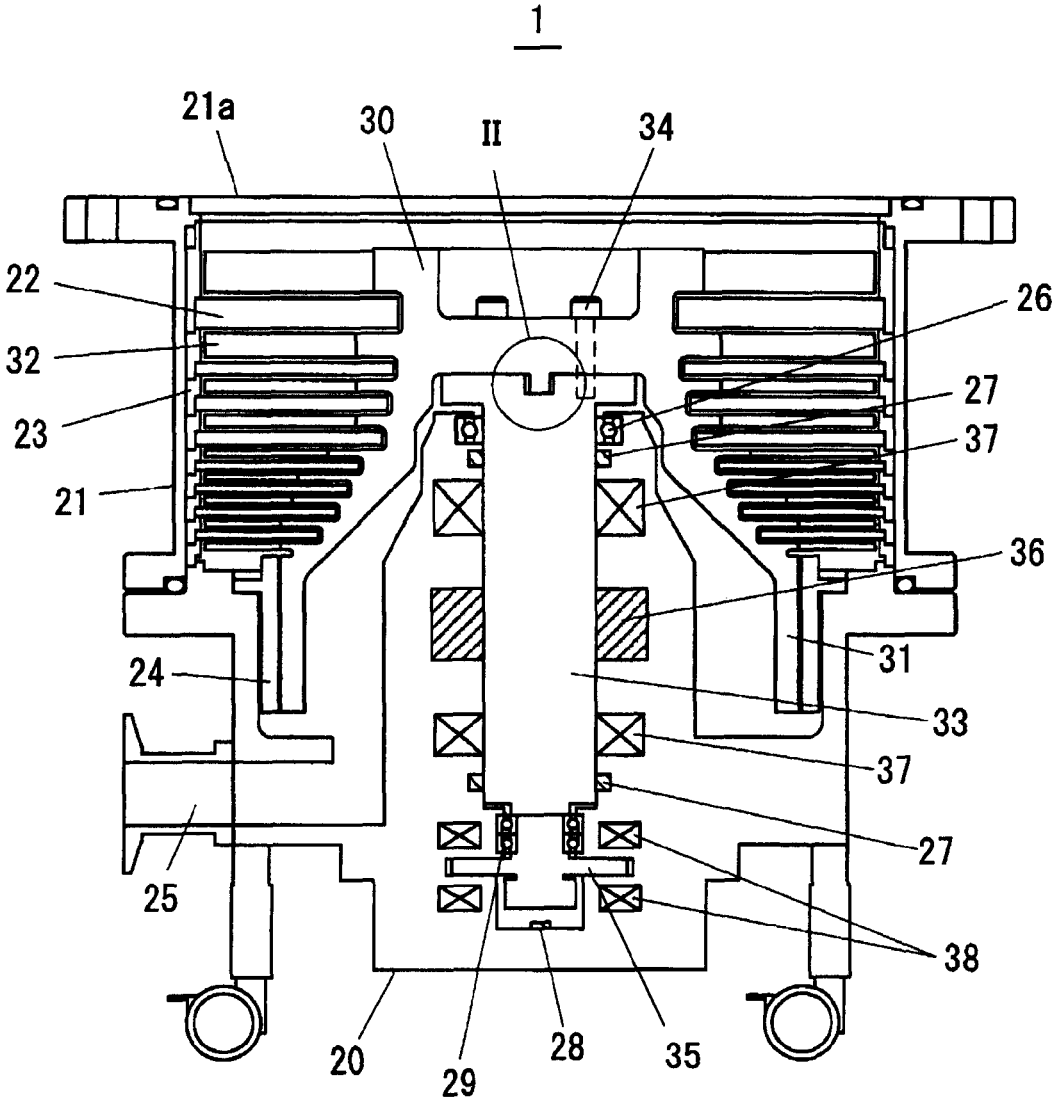
FIG. 1 A cross-sectional view of a pump body 1 of a turbomolecular pump, showing Embodiment 1 according to the present invention.

Hereafter, Embodiment 1 for practicing the present invention is explained with reference to the drawings. FIG. 1 presents a diagram illustrating a vacuum pump according to the present invention, showing a pump main body 1 that constitutes a turbomolecular pump in cross-section. The turbomolecular pump comprises a turbomolecular pump main body 1 and a control unit (not shown).

The turbomolecular pump shown in FIG. 1 is a magnetically-levitated turbomolecular pump, in which a rotor shaft 33 is non-contact supported by a magnetic bearing 37 in the radial direction and a magnetic bearing 38 in the thrust direction, with a rotor 30 being fastened to the rotor shaft 33. The position at which the rotor shaft 33 is levitated is detected by a radial displacement sensor 27 and an axial displacement sensor 28. The rotor shaft 33, which is rotatably supported by the magnetic bearings through magnetic levitation, is driven by a motor 36 to rotate at a high speed.

On a lower side of the rotor shaft 33 is attached a rotor disk 35 through a mechanical bearing 29. On the other hand, on an upper side of the rotor shaft 33 is provided a mechanical bearing 26. The mechanical bearings 26, 29 are mechanical bearings for emergency. When magnetic bearings are not operating, the rotor shaft 33 is supported by the mechanical bearings 26, 29.

The rotor 30 and the rotor shaft 33 are fastened with each other thorough bolts 34. A portion indicated by a sign II is a fitting portion of the rotor 30 and the rotor shaft 33. This fitting structure prevents displacement of the rotor 30 with respect to the rotor shaft 33 in the radial direction due to centrifugal force when rotating at a high speed.

The rotor 30 is provided with a plurality of stages of rotor vanes 32 and a cylindrical threaded rotor 31. On the other hand, on the fixed side are provided a plurality of stages of stator vanes 22, which are alternatingly arranged with the rotary vanes 32 in the axial direction, and a threaded stator 24, which is provided side of the outer periphery of the threaded rotor 31. Each stator vane 22 is mounted on a base 20 through a spacer ring 23. When a pump casing 21 is fixed to the base 20, stacked spacer rings 23 are held between the base 20 and the pump casing 21 to determine the positions of stator vanes 22. In the vacuum pump (turbomolecular pump) according to the present embodiment, the rotor vanes 32 and the threaded rotor 31 constitute an evacuating function portion on the rotor side and the stator vanes 22 and the screw stator 24 constitute an evacuating function portion on the stator side.

The base 20 is provided with an outlet port 25, to which a back pump is connected. By rotating the rotor 30 by a motor 36 at a high speed while magnetically levitating the rotor 30, gas molecules on the side of an intake port 21*a* are evacuated toward the outlet port 25 side.

Figure 2:
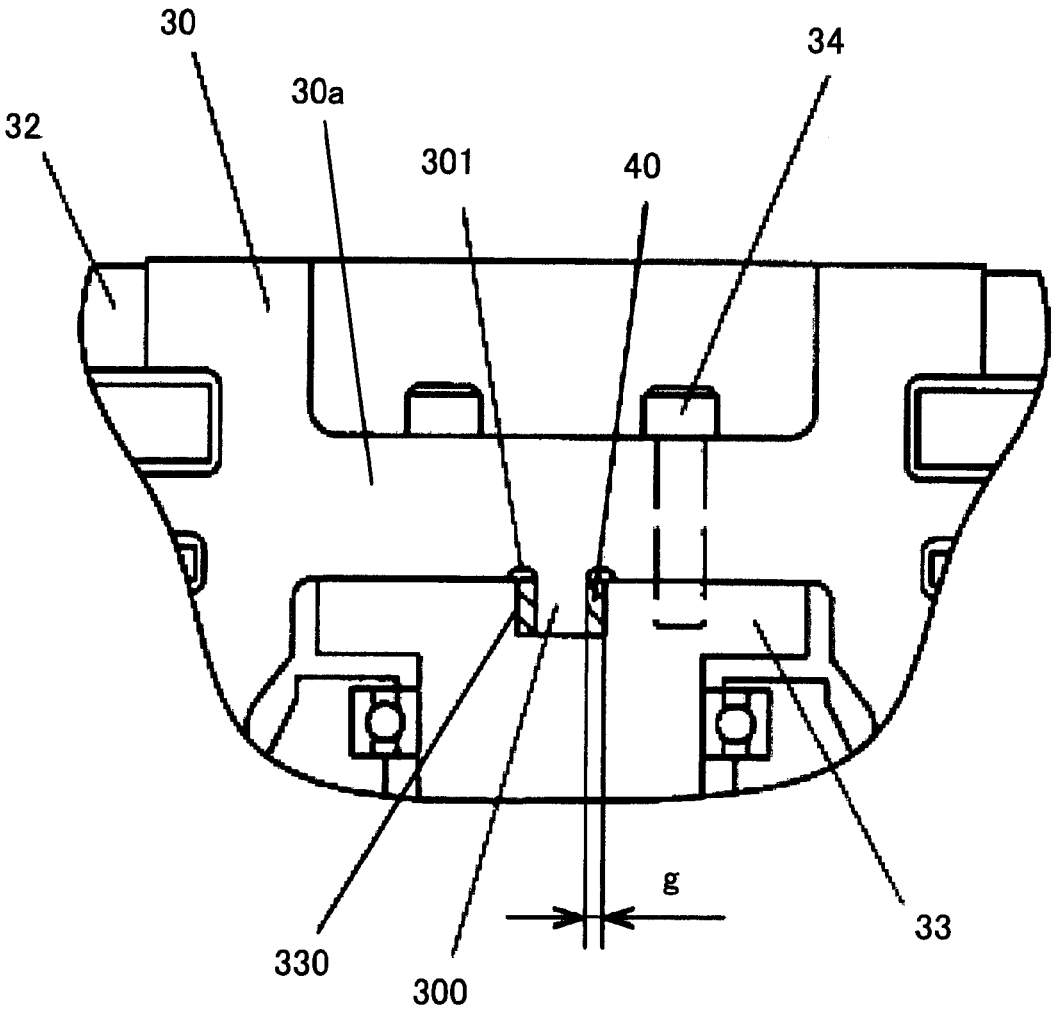
FIG. 2 An enlarged view of a portion of a fitting structure II shown in FIG. 1.

FIG. 2 is an enlarged cross-sectional view of the part II shown in FIG. 1. Hereafter, the fitting structure with which the rotor shaft is fitted in the rotor 30 is explained in detail. The rotor 30 is fastened on the upper side of the rotor shaft 33 with bolts 34. On the fastening surface of the rotor 30 is formed a cylindrical engagement shaft 300 that protrudes toward the rotor shaft 30 side. On the other hand, on the fastening surface of the rotor shaft 33 (upper side) is formed an engagement hole 330 that is open in the form of a cylinder. The engagement shaft 300 of the rotor 30 is inserted in the engagement hole 330. The fitting between the engagement shaft 300 and the engagement hole 330 is arranged to have a clearance allowing presence of a gap therebetween ("clearance fitting"). That is, the diameter of the engagement hole 30 is set slightly larger than the diameter of the engagement shaft 300 so as to have a gap size g of from several micrometers to several tens micrometers between the hole and the shaft.

A gap filling member 40 having a low shear strength is provided in the clearance between the engagement shaft 300 and the engagement hole 330 so as to fill the gap. The gap filling member 40 is formed in a uniform thickness all around the outer periphery of the engagement shaft 300 so that the shaft center of the engagement shaft 300 and the central axis of the engagement hole 330 are coaxial. It is to be noted that in the example shown in FIG. 2, the depth of the engagement hole 330 is set to be equal to the size of the gap filling member 40 in the axial direction. However, if the gap filling member 40 can endure the compression force given due to the centrifugal force, its size along the axial direction may be set to be smaller than the depth of the engagement hole 330.

The gap filling member 40 is provided in order to make it possible to easily separate the rotor 30 and the rotor shaft 33, which have been once fastened to each other, so that it is made of a material that has a shear strength lower than the shear strengths of the materials used for the rotor 30 and the rotor shaft 33. Generally, the rotor 30 may be made of an aluminum alloy, while the rotor shaft 33 may be made of steel. Taking the workability of separation into consideration, it is preferred that the shear strength of the gap filling member 40 is set to be ⅕ times that of the rotor 30 (aluminum alloy). Since the shear strength of aluminum alloy is on the order of 150 MPa, the shear strength of the gap filling member 40 is set to 30 MPa or less. At this level of shear strength, the disassembling operation (which will be explained in detail later) of the rotor 30 and the rotor shaft 33 can be performed with ease by using a simple jig such as a pulley remover.

Specifically, it is preferred to use an adhesive as the gap filling member 40 from the view point of the workability. Various types of adhesive such as resin-based adhesives (epoxy resins, acrylic resins and so on), rubber-based adhesives, etc., can be used as the adhesive. Any adhesive can be adjusted to have shear strength of 30 MPa or less. Instead of adhesives, a ring-shaped member made of a material having low shear strength may be used as the gap filling member 40. In this case, synthetic resins may be conceived as the material having low shear strength. Also, rubber or soft metals may be used as the material having low shear strength.

A method of producing the vacuum pump when an adhesive is used as the gap filling member 40, which is applied on the outer peripheral surface of the engagement shaft 300 by using, for example, a brush. And the engagement shaft 300 and the rotor shaft 33 are put so as to oppose on their fastening surfaces and fastened with the bolts 34 such that the engagement shaft 300 having applied thereon the adhesive is inserted into the engagement hole 330 of the rotor shaft 33.

In order to prevent running off of an excessive adhesive from the gap onto the fastening surfaces when the engagement shaft 300 is inserted into the engagement hole 330, it is recommendable to apply no adhesive to the engagement shaft 300 in an area in the vicinity of the foot portion thereof. As an alternative method, an escape 301 may be formed in the foot portion of the engagement shaft 300 as shown in FIG. 2 so that the run-off adhesive can be led into the escape 301.

It will be more effective if the escape 301 is provided in the foot portion of the engagement shaft 300 and in addition an area where no adhesive is applied is provided in the vicinity of the foot of the engagement shaft 300.

It is necessary to repair or exchange the rotor 30 at a predetermined frequency since the rotary vanes 32 and the rotor 30 suffer plating peeling off and deterioration. Though the frequency of repair/exchange may vary depending on conditions under which the vacuum pump is used, the repair/exchange should be performed considerably frequently, e.g., on the order of from once in a few months to once in a half year.

Figure 3:
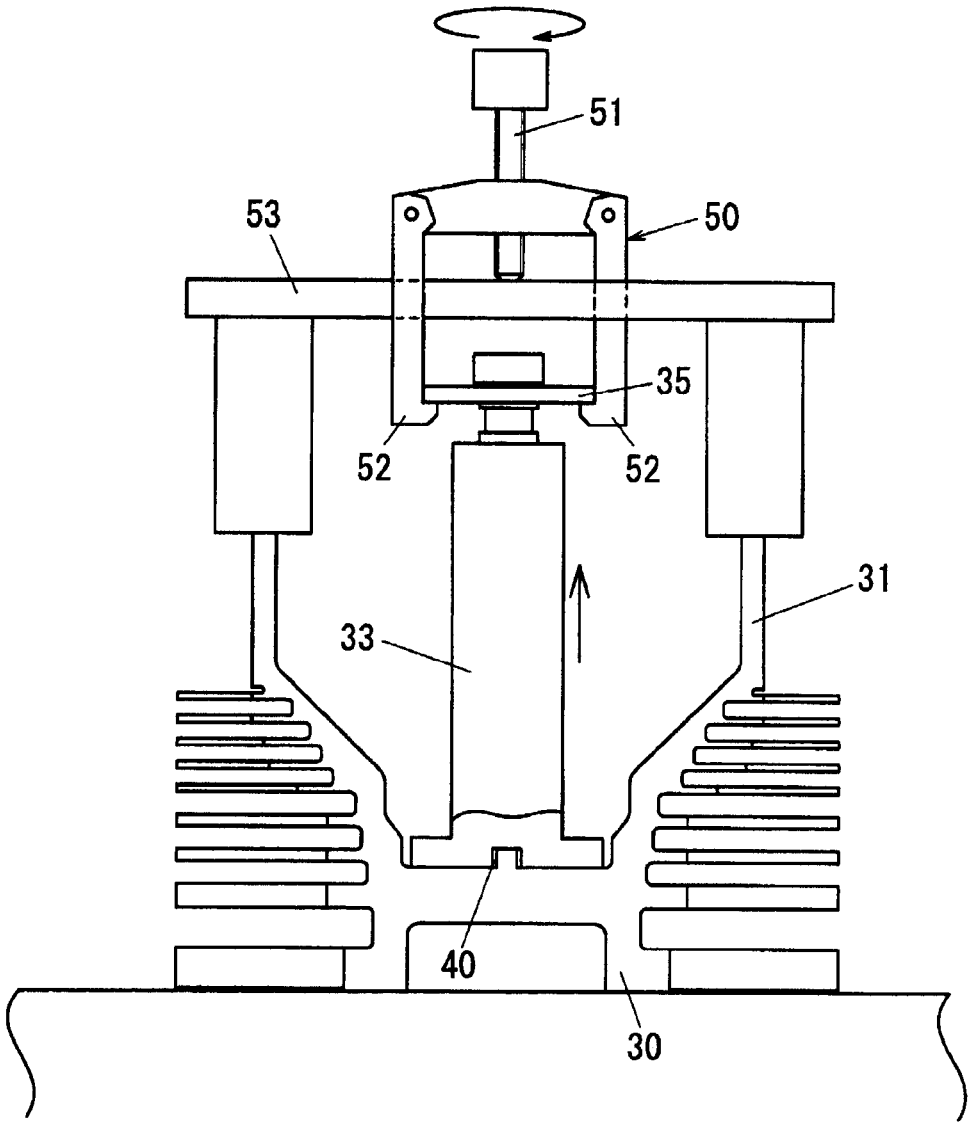
FIG. 3 An illustration of disassembly work of the rotor and the rotor shaft which are shown in FIG. 1.

FIG. 3 is a cross-sectional view showing a process of separating the rotor shaft 33 from the rotor 30.

As shown in FIG. 3, the turbomolecular pump shown in FIG. 1 is placed upside down and the rotor shaft 33 is removed from the rotor 30 by using a pulley remover 50. A support member 53 is hanged over on the ends of the threaded rotor 31 of the rotor 30 and clicks 52 of the pulley remover 50 are engaged with a peripheral portion of a rotor disk 35 attached to the rotor shaft 33. The claw hooks 52 of the pulley remover 50 have each a screw threaded portion (not shown), which is threadably mounted on the screw portion 51, a tip of which abuts an upper surface of a middle portion of a support member 53. When the screw portion 51 is turned, the screw portion 51, the tip of which abuts the support member 53, is twisted out of the main body of the pulley remover 50 downward in the figure, so that the claw hooks 52 move upward. As a result, a portion of the adhesive provided as the gap filling member 40 undergoes shear fracture so that the rotor shaft 33 is drawn out upward.

As mentioned above, according to Embodiment 1, the rotor 30 and the rotor shaft 33 are fitted by "clearance fitting" and the rotor 30 and the rotor shaft 33 are fitted with the gap filling member 40. Therefore, unlike the conventional "shrink fit", it is unnecessary to heat the engagement hole while cool the engagement shaft upon fitting, so that the assembly can be performed very efficiently. Since the gap filling member 40 having a shear strength lower than the shear strengths of the rotor 30 and the rotor shaft 33 is provided in the gap between the engagement hole 330 and the engagement shaft 300, the gap filling member 40 can undergo shear fracture with ease so that the engagement shaft 300 can be drawn out from the engagement hole 330 without difficulty at the time of disassembling.

In the conventional fitting structure formed by "shrink fit" of metals, even if disassembling is successful, the rotor 30 or the rotor shaft 33 are damaged and repairing work of the fitting surfaces is troublesome. On the other hand, according to Embodiment 1 of the present invention, only the gap filling member 40 that fills up the gap between the engagement shaft 300 and the engagement hole 330 is broken and damages to the fitting surfaces of the engagement shaft 300 and the engagement hole 330 can be prevented.

In this manner, the turbomolecular pump according to Embodiment 1 of the present invention, fitting of the rotor 30 and the rotor shaft 33 with each other becomes easy and assembly of the vacuum pump can be performed efficiently. Also, according to the present invention, an advantageous effect can be obtained that in the vacuum pump in which the rotor 30 provided with the rotary vanes 32 rotates at a high speed, the workability of disassembling of the rotor and the rotor shaft can be increased while preventing loosening of the engagement between the engagement shaft 300 and the engagement hole 330 due to high speed rotation.

Embodiment 2

Figure 4:
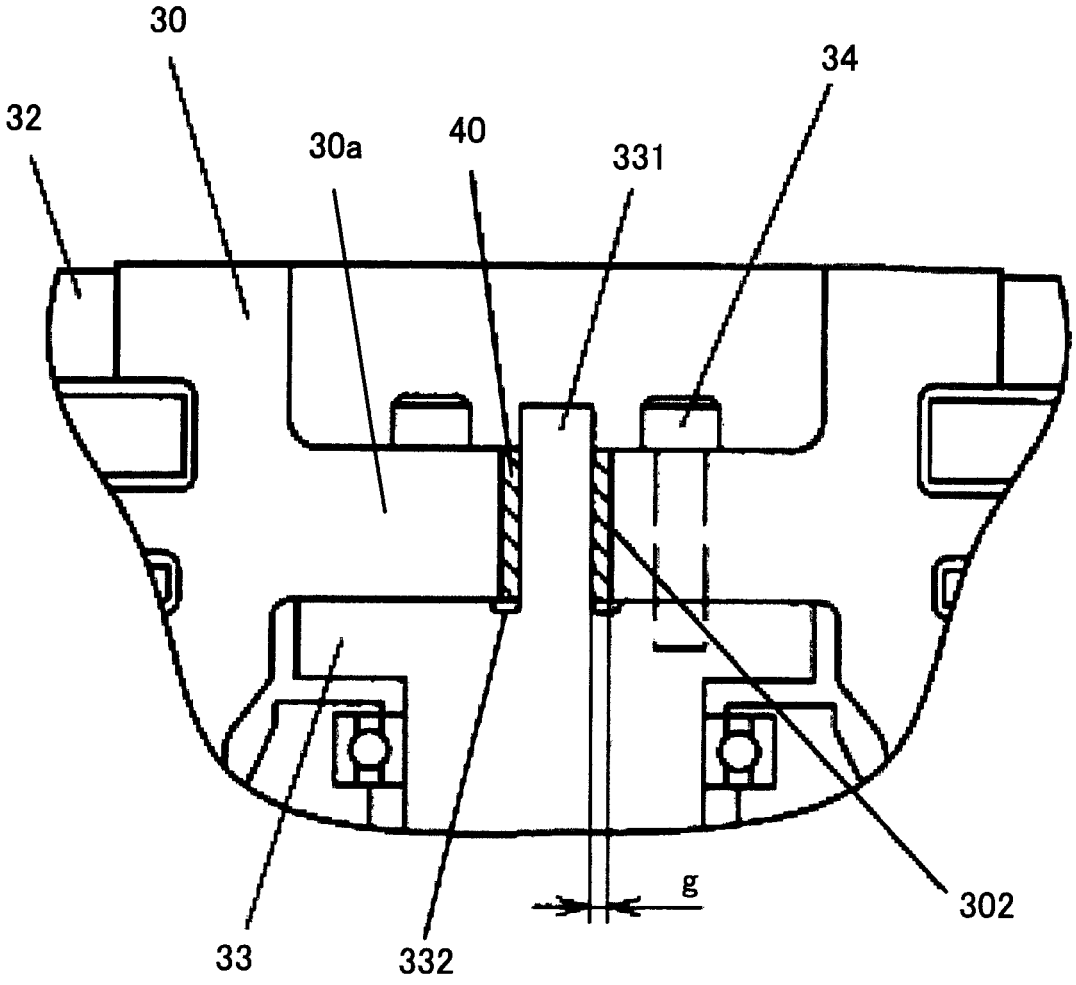
FIG. 4 An enlarged view of a portion of a fitting structure according to Embodiment 2 of the present invention.

FIG. 4 illustrates Embodiment 2 according to the present invention and presents, similarly to FIG. 2, an enlarged diagram showing the fitting structure of the rotor 30 and the rotor shaft 33.

In Embodiment 2 shown in FIG. 4, an engagement hole 302 is formed on the upper side of the rotor 30, extending through an upper portion 30*a* of the rotor 30. On the rotor shaft 33 side, an engagement shaft 331 is formed, which is inserted into the engagement hole 302 of the rotor 30. The engagement shaft 331 extends above an upper side of the upper portion 30*a* through the engagement hole 302 of the rotor 30.

In this case, too, "clearance fitting" is adopted as the fitting between the rotor 30 and the rotor shaft 33. The gap size g between the engagement hole 302 and the engagement shaft 331 is set the same as the gap size g in FIG. 2. Similarly, an escape 332 is formed at the foot portion of the engagement shaft 331.

The gap filling member 40 is formed in a uniform thickness all over the outer periphery of engagement shaft 331 so that the shaft center of the engagement shaft 331 and the center axis of the engagement hole 302 are coaxial.

Also, in Embodiment 2, besides adhesives, synthetic resins, rubbers, soft metals and so on may be used as the gap filling member 40.

Figure 5:
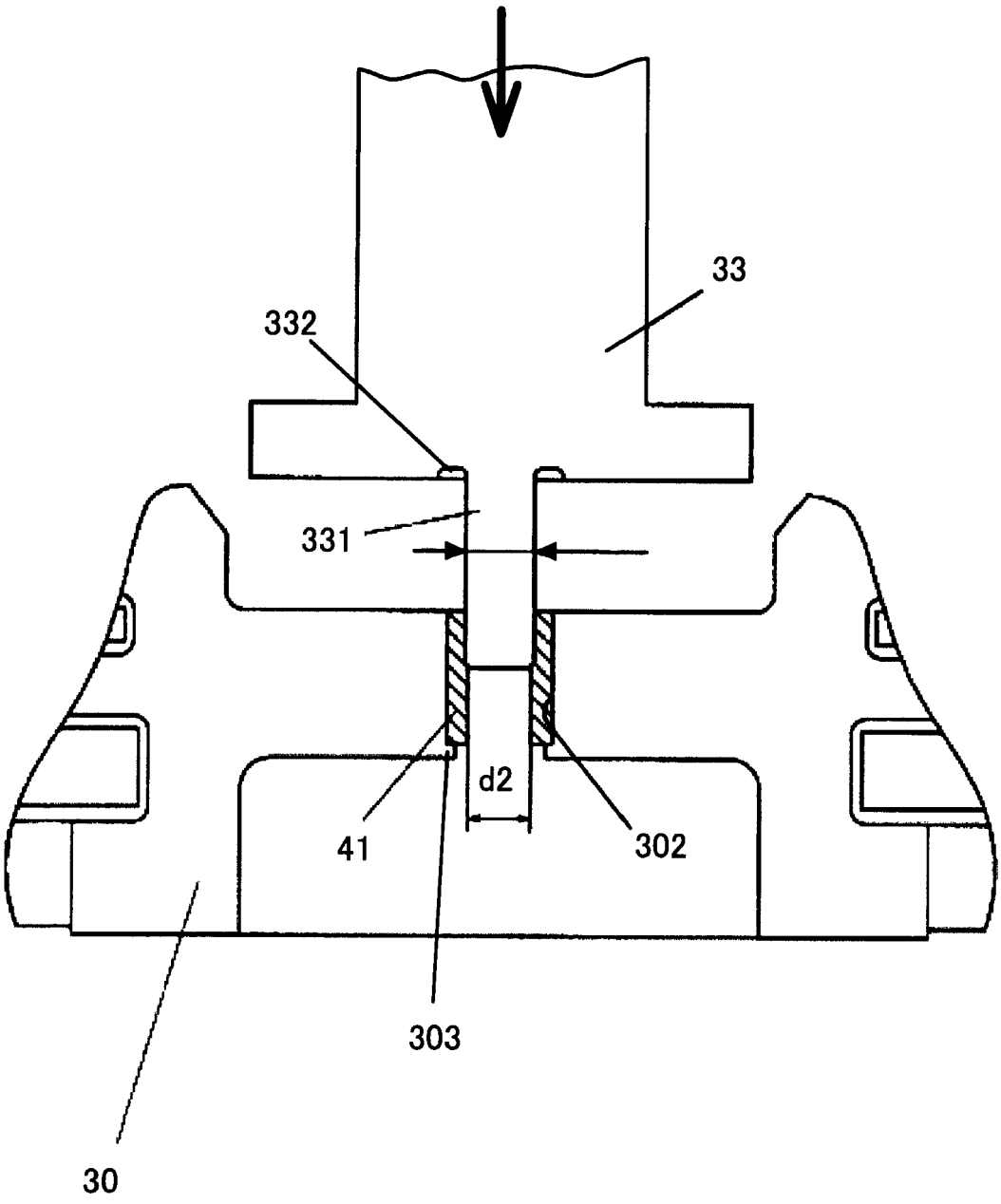
FIG. 5 A diagram for illustrating an assembling method when a ring-shaped thin plate is used as a filling member.

FIG. 5 illustrates how to assemble the vacuum pump when a ring-shaped thin plate made of a material selected from synthetic resins, rubber, soft metals is used as the gap filling member 40.

When a ring-shaped thin plate 41 is used as the gap filling member, the rotor shaft 33 is assembled by a method as illustrated in FIG. 5. When the ring-shaped thin plate 41 is used, it is difficult to set the gap between the engagement hole 302 and the engagement shaft 331 to several micrometers to several tens micrometers as in the case where an adhesive is used, that gap is set so as to have a gap size in the order such that the ring-shaped thin plate 41 can be formed. For example, the gap size is set to about 2 mm. In the engagement hole 302 in which the ring-shaped thin plate 41 is to be fitted is formed a flange 303 against which an end of the ring-shaped thin plate 41 abuts.

The ring-shaped thin plate 41 is formed so as to have an outer diameter that is slightly larger than the inner diameter of the engagement hole 302. The ring-shaped thin plate 41 is inserted into the engagement hole 302 like press fitting until it abuts against the flange 303. The inner diameter d2 of the ring-shaped thin plate 41 is set to be slightly smaller than the outer diameter d1 of the engagement shaft 331. Therefore, when the engagement shaft 331 is inserted into the ring-shaped thin plate 41, it is inserted in such a manner that the inner periphery of the ring-shaped thin plate 41 is scraped away by the engagement shaft 331. As mentioned above, the ring-shaped thin plate 41 is fixed to the engagement hole 302 and the engagement shaft 331 by press fitting the ring-shaped thin plate 41 into the engagement hole 302 and by inserting the engagement shaft 331 into the engagement hole 302 such that the inner periphery of the ring-shaped thin plate 41 is scraped away. Therefore, no gap is formed between any two of the engagement hole 302, the ring-shaped thin plate 41 and the engagement shaft 331. If a gap is formed therebetween, there occurs misalignment between the rotor 30 and the rotor shaft 33 along the radial direction due to high speed rotation, which causes a trouble that vibration is generated due to imbalance.

Also, in the case of the turbomolecular pump according to Embodiment 2, disassembling of the pump is performed in the same manner as Embodiment 1 illustrated in FIG. 3. The same method of disassembling the pump can be applied to the case illustrated in FIG. 5 where the ring-shaped thin plate 41 is used as the gap filling member 40. Also, in the case of the turbomolecular pump according to Embodiment 2, similar effects as those according to Embodiment 1 can be obtained.

Embodiment 3

In Embodiments 1 and 2, the outer circumferential surfaces of the engagement shafts 300, 331 and the inner circumferential surfaces of the engagement holes 330, 302 are formed evenly in axial direction. However, a groove for retaining the adhesive may be formed on the adherend surface.

Figure 6:
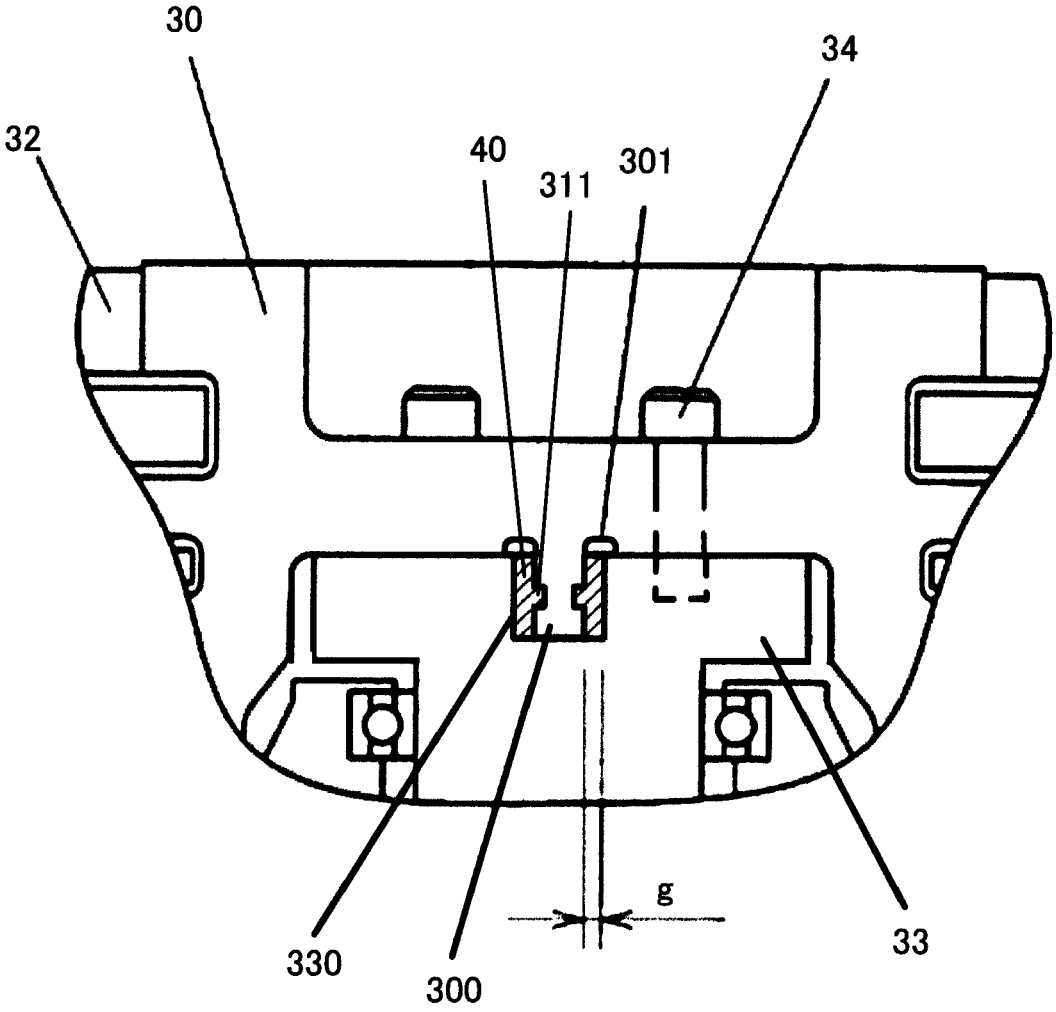
FIG. 6 An enlarged view of a portion of a fitting structure according to Embodiment 3 of the present invention.

The fitting structure between the rotor 30 and the rotor shaft 33 shown in FIG. 6 as Embodiment 3 presents an example of such a structure as mentioned above.

The fitting structure between the rotor 30 and the rotor shaft 33 shown in FIG. 6 as Embodiment 3 differs from the structure shown in FIG. 2 as Embodiment 1 in a point that a groove 311 for retaining the adhesive is formed in the engagement shaft 300 of the rotor 30.

The groove 311 for retaining the adhesive has a rectangular cross-section and is provided annularly along the circumferential direction on the outer circumferential surface of the engagement shaft 300 of the rotor 30. The gap filling member 40 composed of an adhesive is injected in a gap between the outer circumferential surface of the engagement shaft 300 of the rotor 30 and the engagement hole 330 of the rotor shaft 33 and in the groove 311 for retaining the adhesive.

When assembling the rotor 30 and the rotor shaft 33 shown in Embodiment 3, first an adhesive is applied to the outer circumferential surface of the engagement shaft 300 of the rotor 30. At this time, in the case of Embodiment 1 shown in FIG. 2, there is the possibility that the adhesive flows down from upper portion toward lower portion or it is not applied in a uniform thickness. In particular, when the work is carried out in a hurry in a state where the flow of the adhesive is not settled, such possibility is increased.

In contrast, in the case of Embodiment 3 shown in FIG. 6, the applied adhesive is filled in the groove 311 formed in the engagement shaft 300. Since the groove 311 has an edge, the adhesive is retained in the groove 311 and on the outer circumferential surface of the engagement shaft 300 because of surface tension.

Therefore, according to Embodiment 3 of the present invention, the same advantageous effects as those of Embodiment 1 and in addition, run off of the adhesive from the shaft is suppressed. Since this makes it easy to handle the adhesive, the workability is further improved. It is preferred that the annular groove 311 extends along the entire circumference of the engagement shaft 300 in the same depth and the same shape. It is to be noted that other parts of construction in FIG. 6 are the same as in Embodiment 1; corresponding members are assigned the same reference numerals and explanation thereof is omitted.

Embodiment 4

Figure 7:
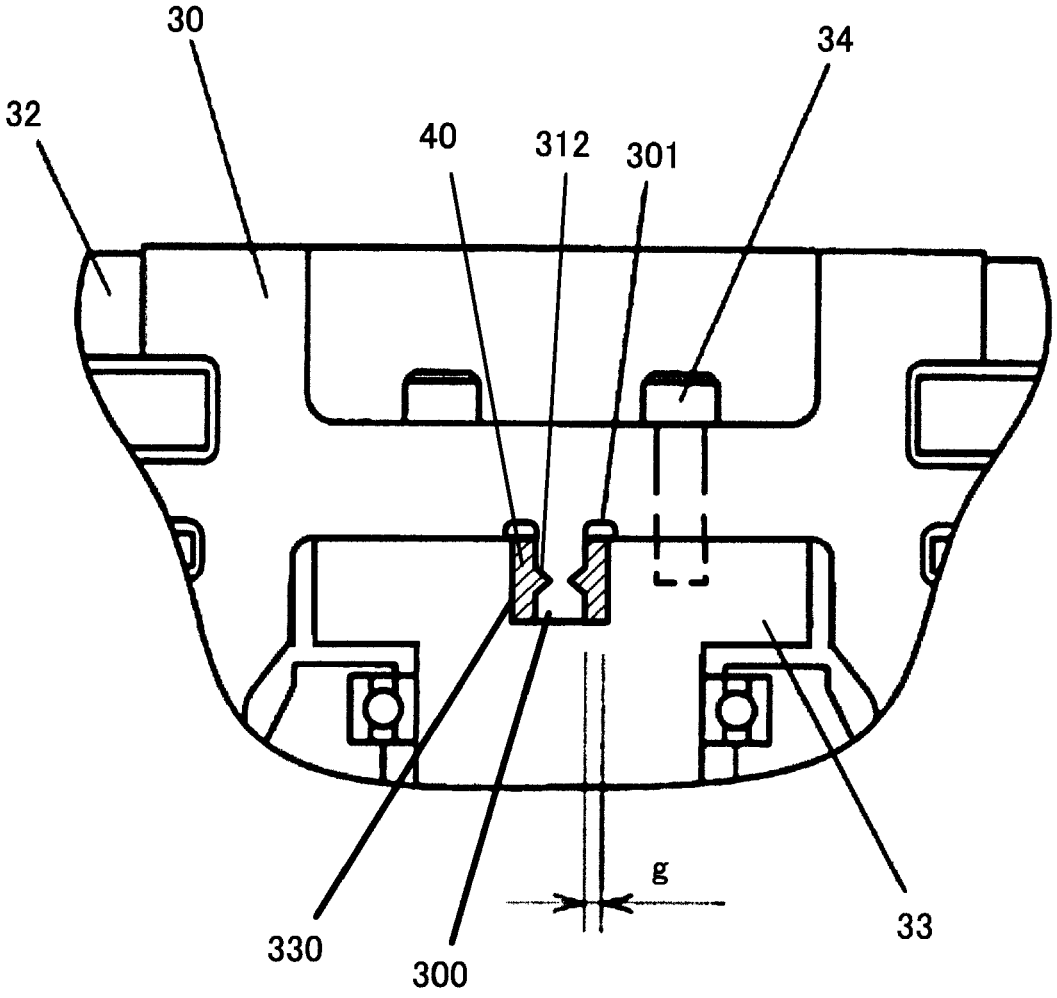
FIG. 7 An enlarged view of a portion of a fitting structure according to Embodiment 4 of the present invention.

FIG. 7 shows Embodiment 4 of the present invention.

The fitting structure between the rotor 30 and the rotor shaft 33 shown in FIG. 7 differs in the shape of the groove 312 for retaining an adhesive from the structure shown in FIG. 6 as Embodiment 3.

In Embodiment 3 shown in FIG. 6, the groove 311 for retaining an adhesive is rectangular in cross-section. On the other hand, in FIG. 7, the groove 312 for retaining an adhesive has a V-shaped cross-section. It is preferred that the annular groove 312, like the annular groove 311, extends along the entire circumference of the engagement shaft 300 in the same depth and the same shape.

Other parts of construction in FIG. 7 are the same as in Embodiment 3; corresponding members are assigned the same reference numerals and explanation thereof is omitted.

Embodiment 5

Figure 8:
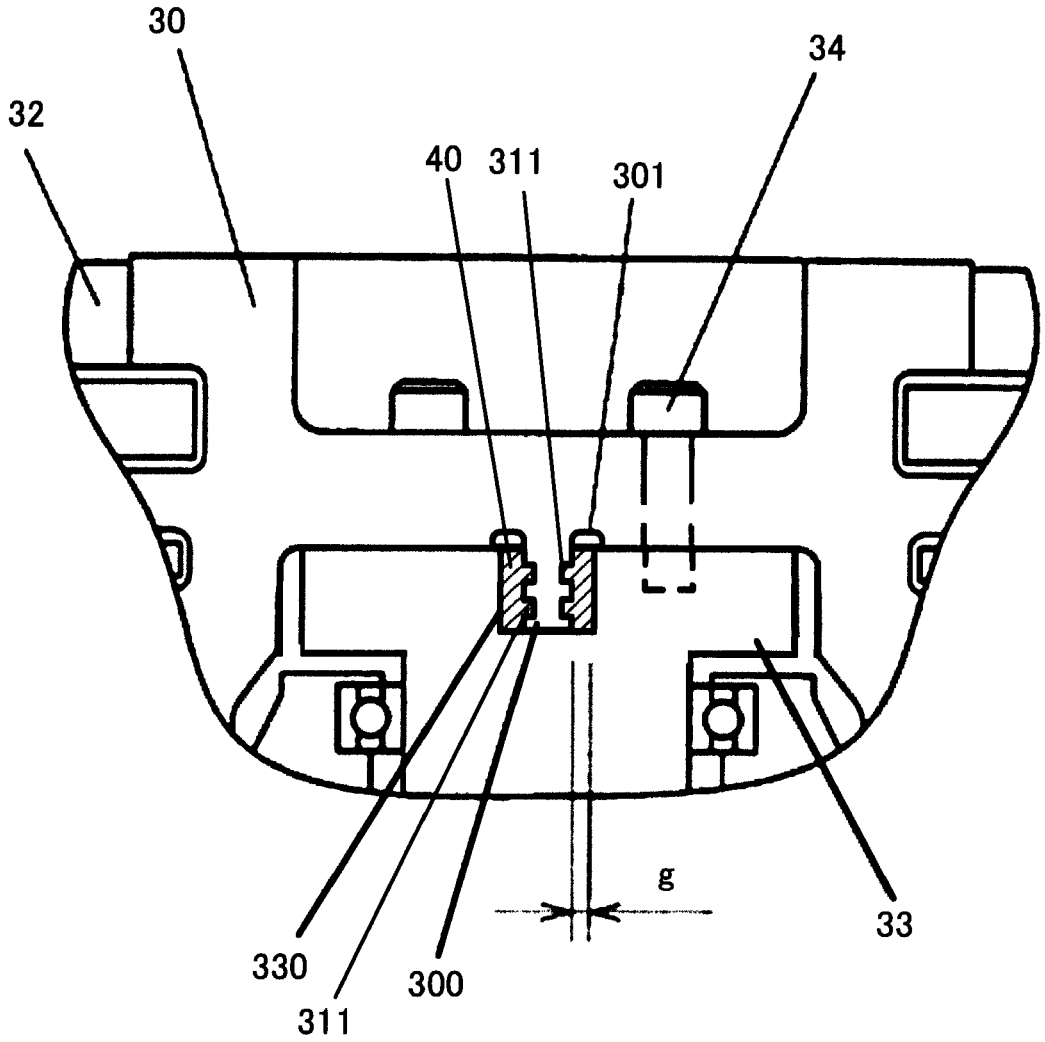
FIG. 8 An enlarged view of a portion of fitting structure according to Embodiment 5 of the present invention.

FIG. 8 shows Embodiment 5 of the present invention.

The fitting structure between the rotor 30 and the rotor shaft 33 shown in FIG. 8 differs from the structure shown in FIG. 6 as Embodiment 3 in that a plurality of grooves 311 for retaining an adhesive are formed.

In Embodiment 3 shown in FIG. 6, only one groove 311 for retaining an adhesive is formed on the outer circumferential surface of the engagement shaft 300 of the rotor 30. In FIG. 8, two annular grooves 311 for retaining an adhesive are formed on the outer circumferential surface of the engagement shaft 300 of the rotor 30. Three or more annular grooves 311 may be formed. Their cross-section may be V-shaped as shown in FIG. 7. Also, their cross-section may be U-shaped.

Other parts of construction in FIG. 8 are the same as in Embodiment 3; corresponding members are assigned the same reference numerals and explanation thereof is omitted.

Embodiment 6

Figure 9:
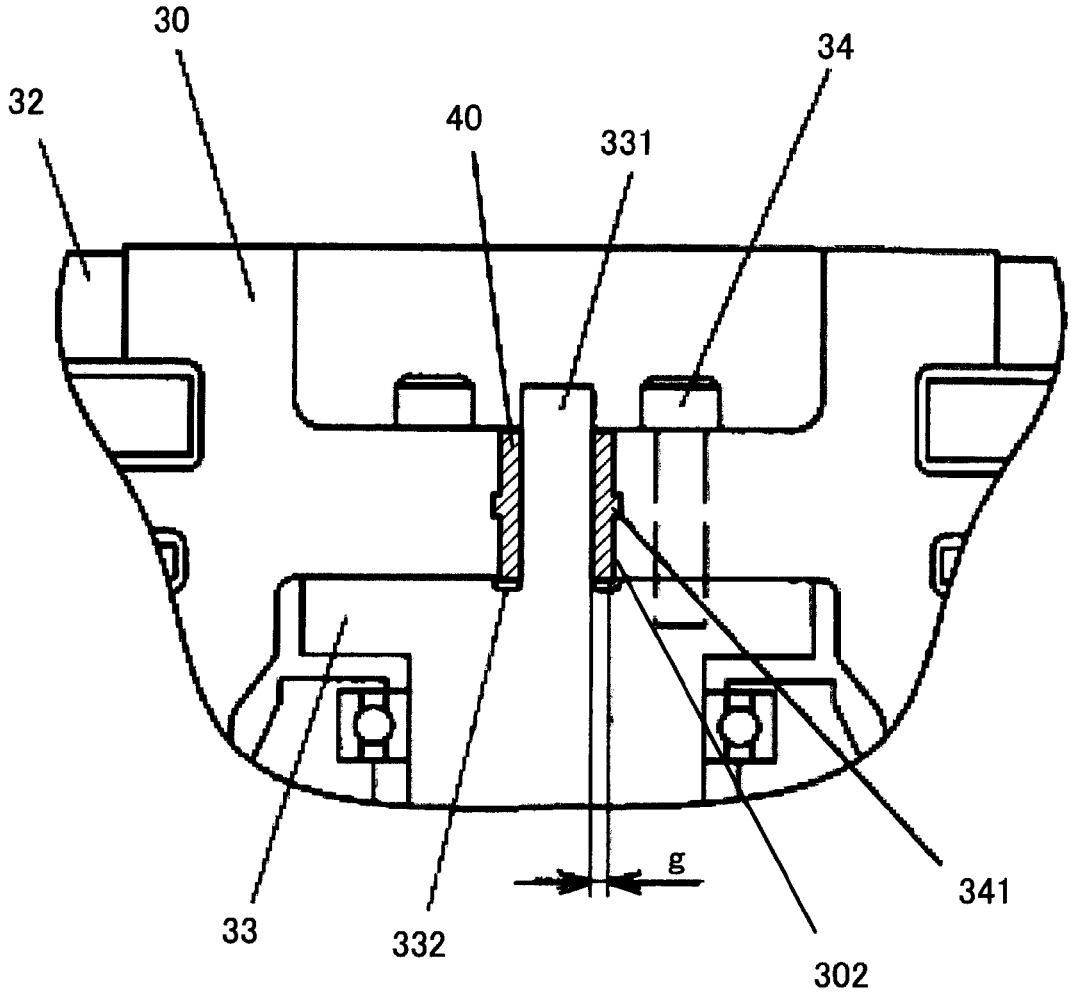
FIG. 9 An enlarged view of a portion of a fitting structure according to Embodiment 6 of the present invention.

The fitting structure between the rotor 30 and the rotor shaft 33 shown in FIG. 9 as Embodiment 6 differs from the structure shown in FIG. 4 as Embodiment 2 in that a groove 341 for retaining an adhesive is formed on the inner circumferential surface of the engagement hole 302 of the rotor 30. That is, the difference is that in Embodiment 6, the groove 341 for retaining an adhesive is formed on the engagement hole 302 of the rotor 30.

The groove 341 for retaining an adhesive, which has a rectangular cross-section, is provided annularly along the inner circumferential surface of the engagement hole 302 in the circumferential direction in a middle portion in the thickness direction of the engagement hole 302 formed on the upper side 30*a* of the rotor 30.

Other parts of construction in FIG. 9 are the same as in Embodiment 2; corresponding members are assigned the same reference numerals and explanation thereof is omitted.

Embodiment 7

In Embodiments 3 through 6 shown in FIGS. 6 through 9, the grooves 311, 312, 341 for retaining an adhesive are formed on the rotor 30 side, respectively.

However, grooves for retaining an adhesive may be formed on the rotor shaft 33 side.

Figure 10:
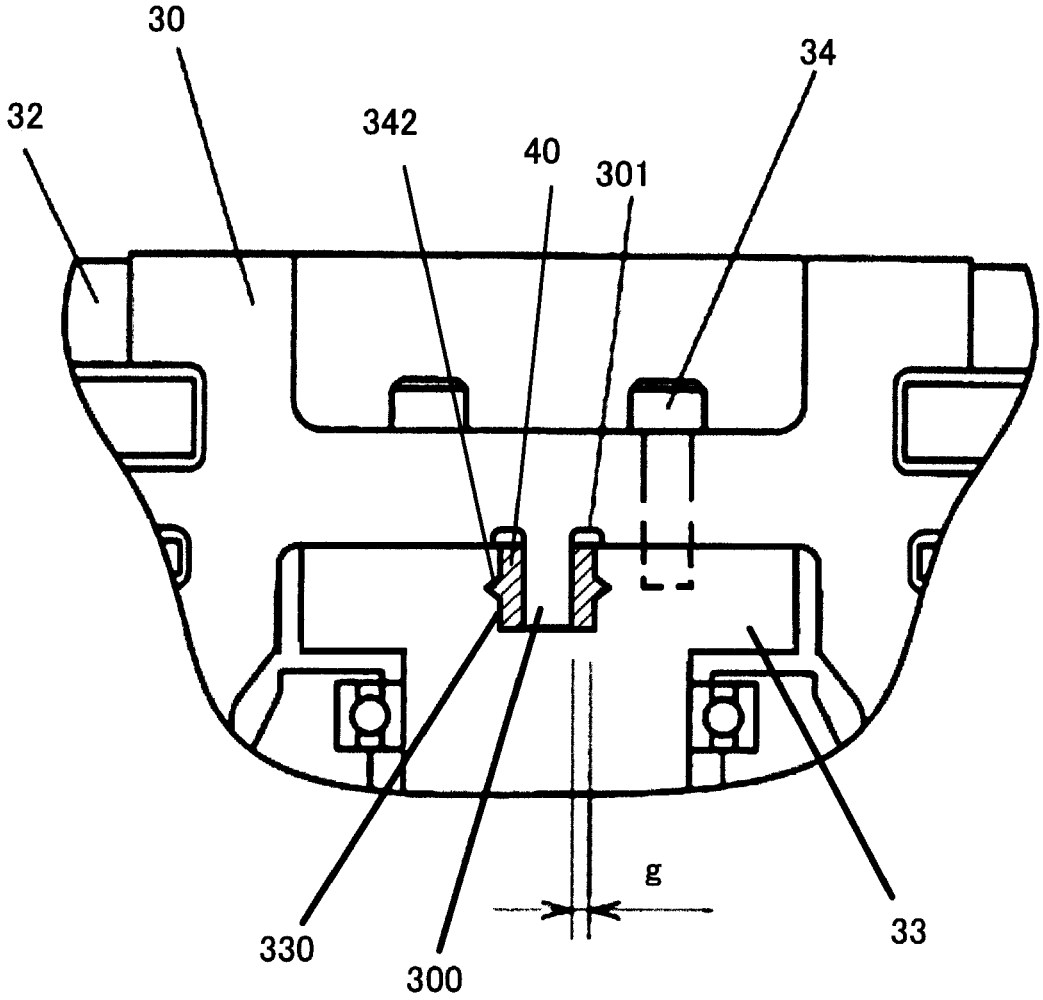
FIG. 10 An enlarged view of a portion of a fitting structure according to Embodiment 7 of the present invention.

In the fitting structure between the rotor 30 and the rotor shaft 33 shown in FIG. 10 as Embodiment 6, a groove 342 for retaining an adhesive is formed in the engagement hole 330 for the rotor shaft 33. That is, Embodiment 7 differs from Embodiment 2 shown in FIG. 2 in that the groove 342 for retaining an adhesive is formed in the engagement hole 330 for the rotor shaft 33.

The groove 342 for retaining an adhesive, which has a V-shaped cross-section, is provided annularly along the inner circumferential surface of the engagement hole 330 for engagement the rotor shaft 33 in the circumferential direction in a middle portion in the thickness direction of the engagement hole 330.

Other parts of construction in FIG. 10 are the same as in Embodiment 4; corresponding members are assigned the same reference numerals and explanation thereof is omitted.

Embodiment 8

Figure 11:
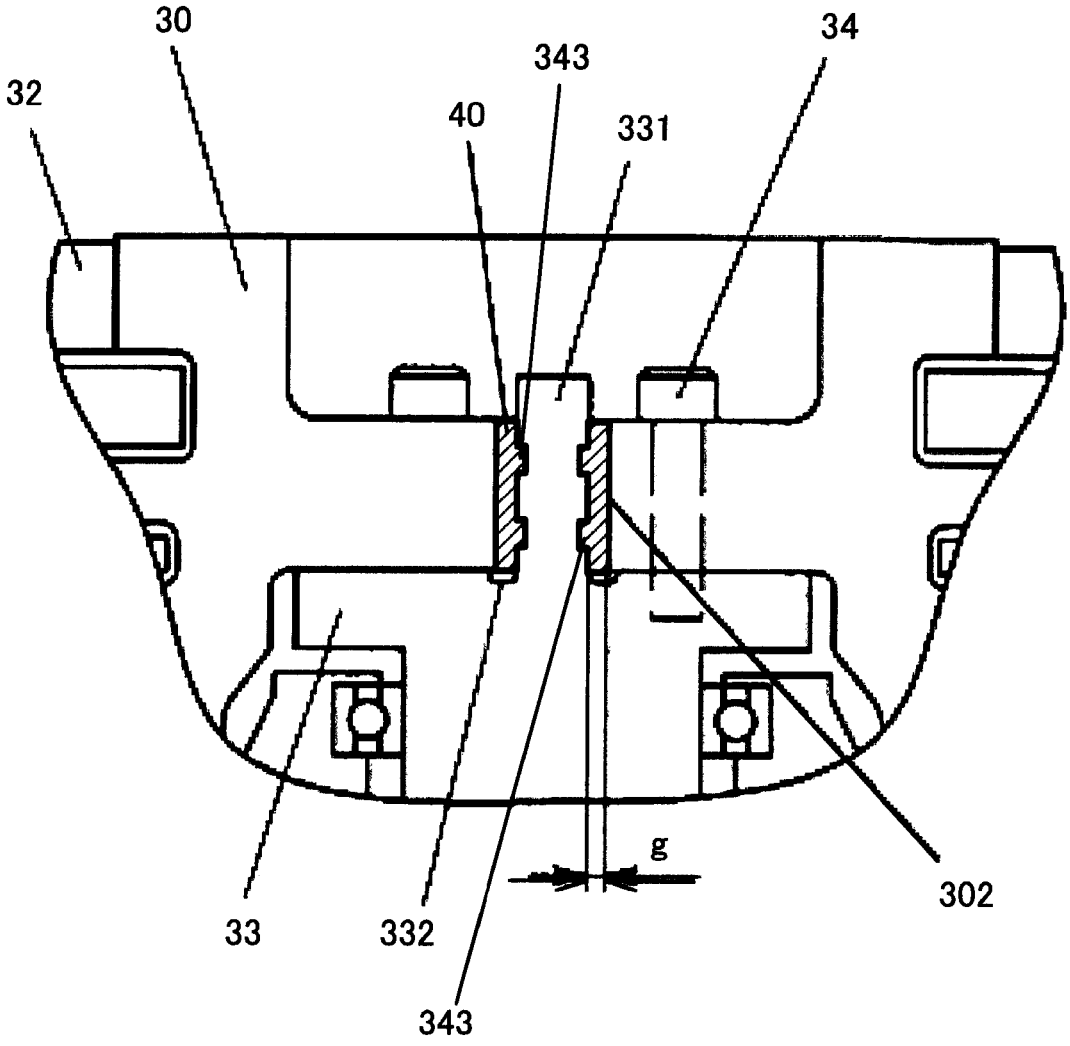
FIG. 11 An enlarged view of a portion of a fitting structure according to Embodiment 8 of the present invention.

In Embodiment 7 shown in FIG. 11 differs from Embodiment 2 shown in FIG. 4 in that a groove 343 for retaining an adhesive is formed in the engagement shaft 331 of the rotor shaft 33.

Two grooves 343 for retaining an adhesion are formed annularly on the outer circumferential surface of the engagement shaft 331 of the rotor shaft 33. One or more than two annular grooves 343 for retaining an adhesive may be formed. The cross-sectional shape may be V-shaped as shown in FIG. 7.

Other parts of construction in FIG. 11 are the same as in Embodiment 2; corresponding members are assigned the same reference numerals and explanation thereof is omitted.

Embodiment 9

In Embodiments 3 through 8 shown in FIGS. 6 through 11, the groove for retaining an adhesive is formed either on the rotor 30 side or on the rotor shaft 33 side.

However, the groove for retaining an adhesive may be formed on both the rotor 30 and the rotor shaft 33. In Embodiment 9 shown in FIG. 12, two grooves 344 for retaining an adhesive are formed on the outer circumferential surface of the engagement shaft 300 of the rotor 30. Also, on the inner circumferential surface of the engagement hole 330 for the rotor shaft 33 is formed one groove 342 for retaining an adhesive.

The grooves 344 and 342 for retaining an adhesive have each a V-shaped cross-section. Furthermore, the grooves 344 and 342 for retaining an adhesive are positioned at different vertical positions.

The shape of the cross-section of the grooves 342, 344 may be rectangular. Furthermore, the grooves 342, 344 may have different cross-sections from each other. One each of the grooves 342, 344 or a plurality of grooves 342 and a plurality of grooves 344 may be formed.

Figure 12:
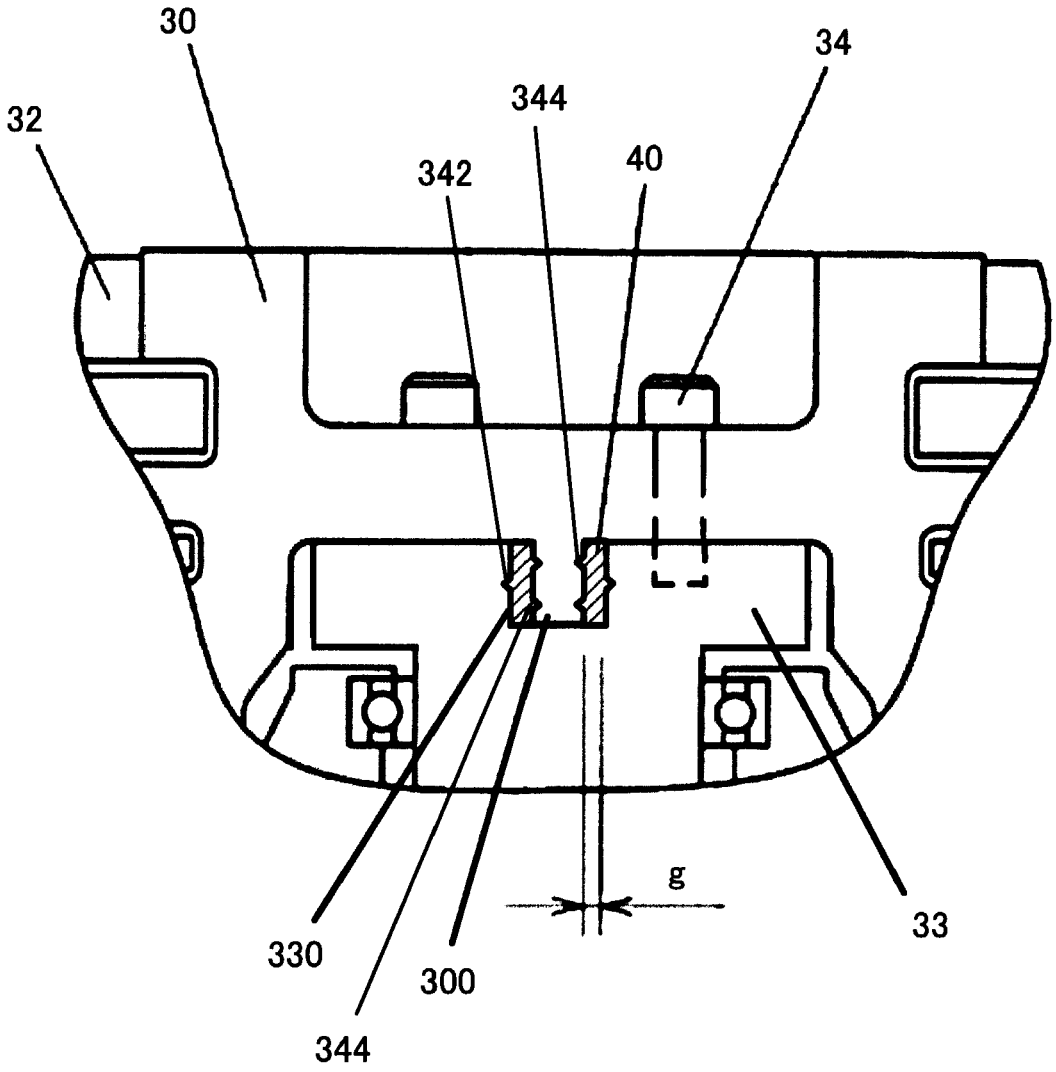
FIG. 12 An enlarged view of a portion of a fitting structure according to Embodiment 9 of the present invention.

Embodiment 9 shown in FIG. 12 differs from Embodiment 7 shown in FIG. 10 in that the groove 344 for retaining an adhesive is provided on the engagement shaft 300 of the rotor 30. Other parts of construction in FIG. 12 are the same as in Embodiment 7 shown in FIG. 10; corresponding members are assigned the same reference numerals and explanation thereof is omitted.

Embodiment 10

Figure 13:
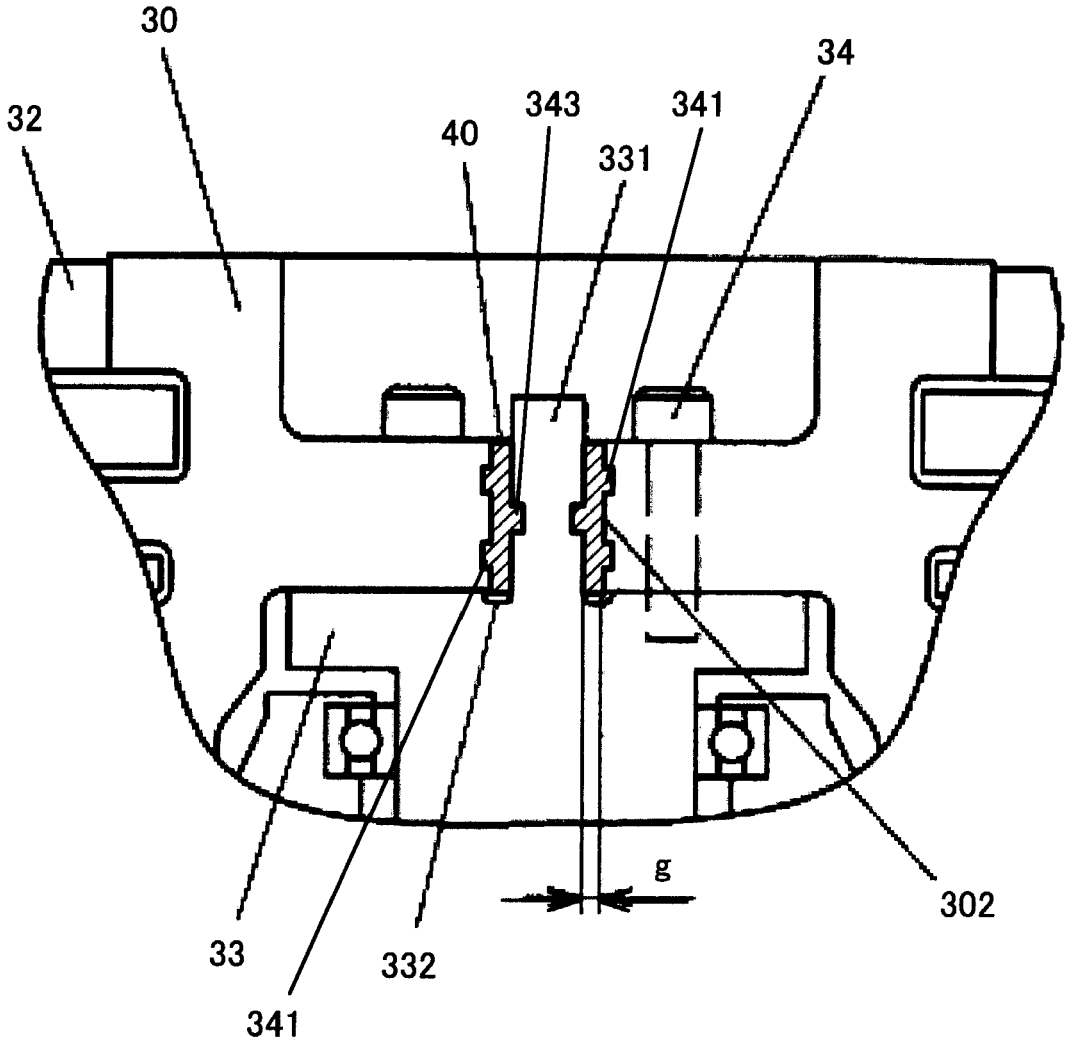
FIG. 13 An enlarged view of a portion of a fitting structure according to Embodiment 10 of the present invention.

In Embodiment 10 shown in FIG. 13, one groove 343 for retaining an adhesive is formed on the outer circumferential surface of the engagement shaft 331 of the rotor shaft 33. On the other hand, two grooves 341 for retaining an adhesive are formed on the inner circumferential surface of the engagement hole 302 for the rotor 30.

The grooves 343 and 341 for retaining an adhesive have each a rectangular cross-section. Furthermore, the grooves 343 and 341 for retaining an adhesive are positioned at different vertical positions. The shape of the cross-section of the grooves 341, 343 may be V-shaped. The grooves 341, 343 may have different cross-sections from each other. One each of the grooves 341, 343 or a plurality of grooves 341 and a plurality of grooves 343 may be formed.

Embodiment 10 shown in FIG. 13 differs from Embodiment 6 shown in FIG. 9 in that the groove 343 for retaining an adhesive is provided on the engagement shaft 331 of the rotor 33. Other parts of construction in FIG. 13 are the same as in Embodiment 6 shown in FIG. 9; corresponding members are assigned the same reference numerals and explanation thereof is omitted.

(Other Variations)

The shape of the groove for retaining an adhesive has been explained with reference to those examples with rectangular or V-shaped cross-sections. However, the present invention is not limited to these and various shapes may be adopted for the groove.

Figure 14:
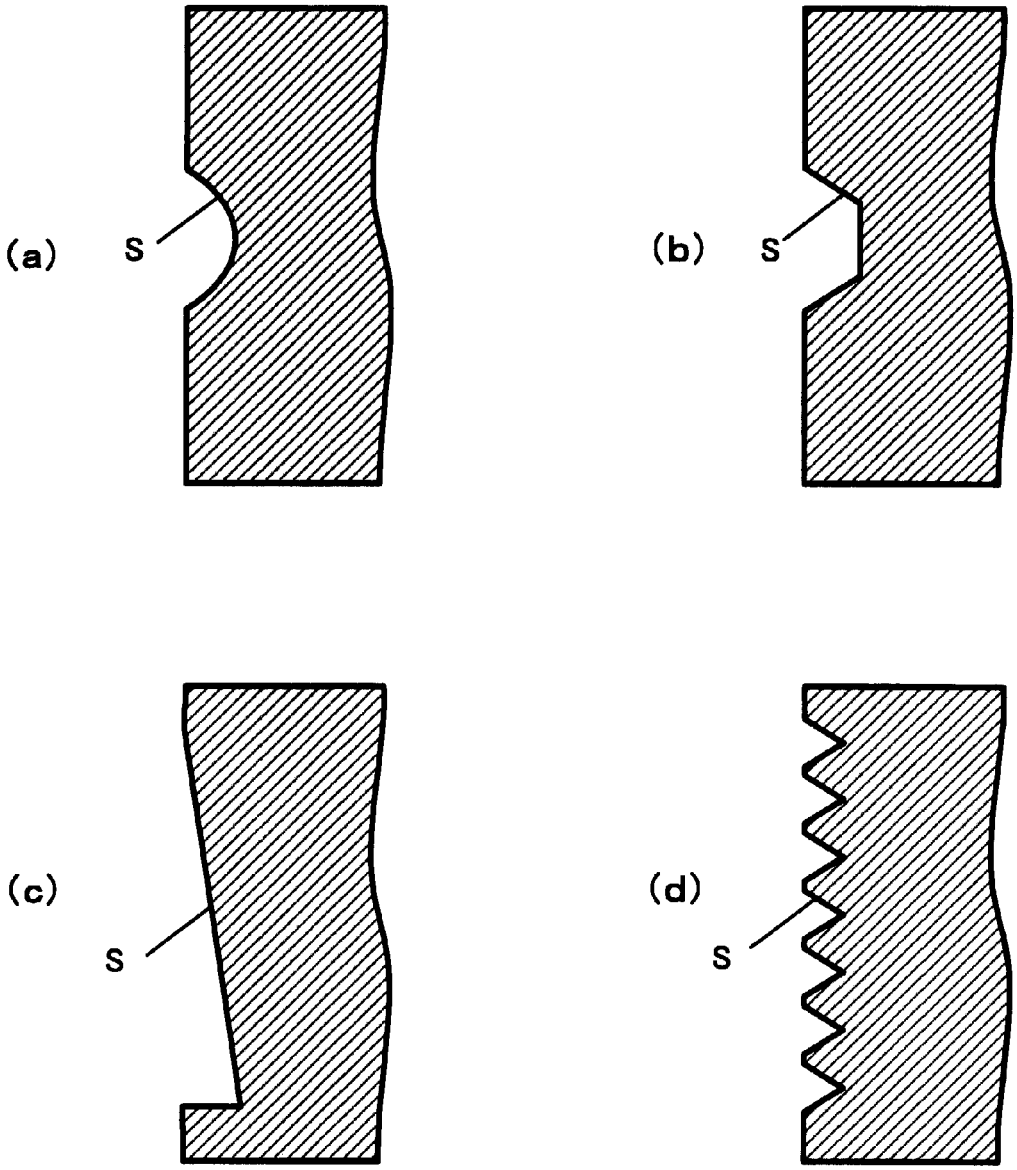
FIG. 14 (*a*) to (*d*) each presenting a diagram showing a variation of the engagement hole of the present invention.

FIGS. 14(*a*) to (*d*) show variations relating to the shape of the groove for retaining an adhesive.

In FIG. 14(*a*), the groove S has a semi-circular or a semi-elliptical cross-section. In FIG. 14(*b*), the groove S has a cross-section of a truncated polygonal pyramid. In FIG. 14(*c*), the groove S has a cross-section with a flat bottom and a slope from a top to the bottom. In FIG. 14(*d*), the groove S has a helical cross-section.

As mentioned above, according to Embodiments 1 through 10, the fitting of the rotor 30 and the rotor shaft 33 is achieved by providing the gap filling member 40 in the gap between the rotor 30 and the rotor shaft 33. As a result, it becomes unnecessary to heat the engagement hole and cool the engagement shaft upon the fitting unlike the conventional "shrink fit", thus facilitating a very efficient assembly work.

The gap filling member 40 has a shear strength that is lower than the shear strengths of the rotor 30 and the rotor shaft 33 and is easily disrupted, so that disassembling of the vacuum pump is very easy, so that repairs/exchange of the rotor 30 can be performed efficiently.

In addition, in this case, the rotor 30 and the rotor shaft 33 are not damaged upon the disassembling of the vacuum pump unlike the conventional "shrink fit". This makes it easier to reassemble the vacuum pump after the disassembling.

When an adhesive is used as the gap filling member 40, a groove for retaining the adhesive may be formed on at least one of the rotor 30 or the rotor shaft 33. By so doing, it is possible to prevent run off of the adhesive upon applying the adhesive on the bonding surface, so that application of the adhesive can be performed efficiently.

The above-mentioned embodiments may be used singly or in any combinations. By so doing, the advantageous effects of the embodiments can be exhibited singly or in synergism. As far as the features of the present invention are not spoiled, the present invention is not limited to the above-mentioned embodiments.

For example, the above-mentioned turbomolecular pump is of the type of magnetic bearing. However, the present invention may be applied to a turbomolecular pump of a type other than the magnetic bearing. Furthermore, the present invention can be applied to not only turbomolecular pumps, but also vacuum pumps such as drag pumps in which a thread groove rotor rotates at a high speed.

Furthermore, the present invention may be modified in various manners within the scope of the present invention. In short, the present invention may be applied to a vacuum pump as far as it comprises a rotor shaft rotatably supported by a bearing and rotatable at a high speed by a motor; a rotor fastened to one end of the rotor shaft in the axial direction thereof provided with an evacuating function portion; an engagement portion provided at a fastening portion of the rotor shaft and the rotor, including an engagement hole formed on one of the rotor shaft and the rotor and an engagement shaft provided on the other of the rotor shaft and the rotor to be inserted into the engagement hole; and a filling member having a shear strength lower than shearing strengths of the rotor and the rotor shaft and provided in a gap between the engagement hole and the engagement shaft.

The disclosure of the following priority application is herein incorporated by reference: Japanese Patent Application No. 2010-31233.

The invention claimed is:

1. A vacuum pump comprising:

a rotor shaft that is rotatably supported by a bearing and driven by a motor to rotate at a high speed;

a rotor that is fastened to one end of the rotor shaft in axial direction thereof and is provided with an evacuating function portion which comprises a plurality of rotor vanes and a cylindrical threaded rotor;

an engagement portion being provided in a fastening portion of the rotor shaft and the rotor, including an engagement hole formed on one of the rotor shaft and the rotor and an engagement shaft formed on the other of the rotor shaft and the rotor to be inserted into the engagement hole; and a filling member provided in a gap between the engagement hole and the engagement shaft, having shear strength lower than respective shear strengths of the rotor and the rotor shaft, wherein:

the gap is formed between an entirety of an outer periphery of the engagement shaft and an entirety of an inner periphery of the engagement hole, so that a fit between the engagement shaft and the engagement hole is a clearance fit; and when the rotor and the rotor shaft are disassembled, the filling member undergoes fracture.

2. The vacuum pump according to claim 1, wherein the filling member comprises an adhesive that bonds an inner circumferential surface of the engagement hole and an outer circumferential surface of the engagement shaft.

3. The vacuum pump according to claim 2, wherein a groove for retaining the adhesive is formed on at least one of the engagement hole and the engagement shaft, the groove being ditched on the inner circumferential surface of the engagement hole or on the outer circumferential surface of the engagement shaft.

4. The vacuum pump according to claim 3, wherein the rotor shaft is provided with the engagement shaft, the rotor is provided with the engagement hole, and the groove for retaining the adhesive is provided in the engagement shaft of the rotor shaft.

5. The vacuum pump according to claim 3, wherein the rotor shaft is provided with the engagement hole, the rotor is provided with the engagement shaft, and the groove for retaining the adhesive is provided in the engagement hole for the rotor shaft.

6. The vacuum pump according to claim 3, wherein the groove for retaining the adhesive is provided annularly along the inner circumferential surface of the engagement hole or along the outer circumferential surface of the engagement shaft in a circumferential direction thereof.

7. The vacuum pump according to claim 3, wherein a plurality of the grooves for retaining the adhesive are provided annularly along the inner circumferential surface of the engagement hole or along the outer circumferential surface of the engagement shaft in a circumferential direction thereof.

8. The vacuum pump according to claim 3, wherein the groove for retaining the adhesive is provided on both the inner circumferential surface of the engagement hole and the outer circumferential surface of the engagement shaft.

9. The vacuum pump according to claim 2, wherein an escape for receiving the adhesive is provided on a foot portion of the engagement shaft.

10. The vacuum pump according to claim 1, wherein the filling member comprises a ring-shaped thin plate.

11. The vacuum pump according to claim 1, wherein the filling member has shear strength that is equal to or less than ⅕ of shear strength of the rotor.

12. The vacuum pump according to claim 1, wherein the filling member is formed in a uniform thickness all around an outer periphery of the engagement shaft, so that a center of the engagement shaft and a central axis of the engagement hole are coaxial.

13. The vacuum pump according to claim 1, wherein the filling member covers the outer periphery of the engagement shaft for an entire circumference of the engagement shaft, and wherein the filling members covers the entire inner periphery of the engagement hole for an entire circumference of the engagement hole.

* * * * *